US011236764B2

(12) United States Patent
Phui et al.

(10) Patent No.: US 11,236,764 B2
(45) Date of Patent: Feb. 1, 2022

(54) PUMP WITH HOUSING HAVING INTERNAL GROOVES

(71) Applicant: Aerojet Rocketdyne, Inc., Sacramento, CA (US)

(72) Inventors: Khin Phui, Cucamonga, CA (US); Sen Meng, Reseda, CA (US)

(73) Assignee: Aerojet Rocketdyne, Inc., Canoga Park, CA (US)

( * ) Notice: Subject to any disclaimer, the term of this patent is extended or adjusted under 35 U.S.C. 154(b) by 0 days.

(21) Appl. No.: 16/767,820

(22) PCT Filed: Oct. 12, 2018

(86) PCT No.: PCT/US2018/055534
§ 371 (c)(1),
(2) Date: May 28, 2020

(87) PCT Pub. No.: WO2019/108312
PCT Pub. Date: Jun. 6, 2019

(65) Prior Publication Data

US 2021/0003138 A1 Jan. 7, 2021

Related U.S. Application Data

(60) Provisional application No. 62/592,662, filed on Nov. 30, 2017.

(51) Int. Cl.

| | |
|---|---|
| ***F04D 29/52*** | (2006.01) |
| ***F04D 29/42*** | (2006.01) |
| ***F04D 29/68*** | (2006.01) |

(52) U.S. Cl.
CPC ..... *F04D 29/52* (2013.01); *F04D 29/4293* (2013.01); *F04D 29/688* (2013.01); *F05D 2250/50* (2013.01)

(58) Field of Classification Search
CPC .... F04D 29/52; F04D 29/526; F04D 29/4293; F04D 29/688; F04D 29/522;
(Continued)

(56) References Cited

U.S. PATENT DOCUMENTS 4,086,022 A * 4/1978 Freeman ..... F01D 11/08 415/119
4,466,772 A * 8/1984 Okapuu ..... F01D 11/08 415/173.5
(Continued)

FOREIGN PATENT DOCUMENTS

| | | | |
|---|---|---|---|
| CN | 105545814 | | 5/2016 |
| JP | H09144699 | * | 3/1997 |
| JP | H09144699 | | 6/1997 |

OTHER PUBLICATIONS

International Search Report and Written Opinion for International Application No. PCT/US2018/055534 dated Jan. 21, 2019.
(Continued)

*Primary Examiner* — Bryan M Lettman

(57) ABSTRACT

A pump includes an axial inducer. The axial inducer includes a housing that has an internal surface that defines an axial fluid passage. A rotor is disposed about a central axis in the fluid passage. The rotor includes at least one blade that defines at least one blade tip. The internal surface of the housing defines a plurality of grooves adjacent the at least one blade tip. The grooves are elongated in a circumferential direction.

13 Claims, 2 Drawing Sheets

(58) Field of Classification Search
CPC .... F04D 29/528; F04D 29/545; F04D 29/547; F04D 29/548; F04D 29/54; F04D 29/541; F04D 29/681; F04D 29/685; F05D 2250/50
See application file for complete search history.

(56) References Cited

U.S. PATENT DOCUMENTS

| | | | | |
|---|---|---|---|---|
| 7,861,823 | B2 * | 1/2011 | Prasad | B64D 33/02 181/214 |
| 2008/0044273 | A1 * | 2/2008 | Khalid | F04D 29/321 415/57.4 |
| 2011/0027076 | A1 * | 2/2011 | Alison-Youel | F04D 29/181 415/185 |
| 2011/0123321 | A1 * | 5/2011 | Kilkenny | F04D 3/02 415/185 |
| 2015/0044027 | A1 | 2/2015 | Van Dam | |

OTHER PUBLICATIONS

International Preliminary Report on Patentability for International Patent Application No. PCT/US2018/055534 dated Jun. 2, 2020.

* cited by examiner

PUMP WITH HOUSING HAVING INTERNAL GROOVES

CROSS-REFERENCE TO RELATED APPLICATION

This application claims priority to U.S. Provisional Application No. 62/592,662 filed Nov. 30, 2017.

STATEMENT REGARDING FEDERALLY SPONSORED RESEARCH OR DEVELOPMENT

This invention was made with government support under contract number NNM16AA02C awarded by the National Aeronautics and Space Administration. The government has certain rights in the invention.

BACKGROUND

Pumps are commonly known and used to pressurize fluids. For example, a pump may include an inducer that may have one or more blades that extend from a rotor to a radially offset tip. The rotor and blades rotate to pressurize fluid that enters the pump.

SUMMARY

A pump according to an example of the present disclosure includes an axial inducer that has a housing having an internal surface that defines an axial fluid passage. A rotor is disposed about a central axis in the fluid passage of the housing and has at least one blade that defines at least one blade tip. The internal surface of the housing defines a plurality of grooves adjacent the at least one blade tip. The grooves are elongated in a circumferential direction.

In a further embodiment of any of the foregoing embodiments, each of the grooves is an endless groove.

In a further embodiment of any of the foregoing embodiments, the plurality of grooves includes an ended groove.

In a further embodiment of any of the foregoing embodiments, the plurality of grooves includes an endless groove and an ended groove aft of the endless groove.

In a further embodiment of any of the foregoing embodiments, the plurality of grooves includes a plurality of endless grooves and a plurality of ended grooves that are aft of the plurality of endless grooves.

In a further embodiment of any of the foregoing embodiments, the plurality of grooves includes a plurality of endless grooves, and the endless grooves are uniformly axially-spaced apart.

In a further embodiment of any of the foregoing embodiments, the plurality of grooves are of common aspect ratio with respect to groove depth and groove width.

In a further embodiment of any of the foregoing embodiments, the plurality of grooves have a constant cross-section.

In a further embodiment of any of the foregoing embodiments, the one or more blades begin at a first axial location. The one or more blades terminate at a second axial position. The plurality of grooves begin at a third axial location. The at least one groove terminates at a fourth axial position, and the fourth axial location is forward of the second axial location.

In a further embodiment of any of the foregoing embodiments, the internal surface of the housing includes a band aft of the plurality of grooves that excludes any of the one or more grooves.

In a further embodiment of any of the foregoing embodiments, the plurality of grooves define, with respect to a reference plane perpendicular to the central axis, a forward pitch angle, and the at least one blade defines, with respect to the reference plane, an aft pitch angle.

A pump according to an example of the present disclosure includes an axial inducer that has a housing having an internal surface that defines an axial fluid passage. A rotor is disposed about a central axis in the fluid passage of the housing and has at least one blade defining at least one blade tip. The internal surface of the housing defines a plurality of grooves adjacent the at least one blade tip. The plurality of grooves define, with respect to a reference plane perpendicular to the central axis, a forward pitch angle. The blade defines, with respect to the reference plane, an aft pitch angle.

In a further embodiment of any of the foregoing embodiments, the forward pitch angle and the aft pitch angle are congruent angles.

In a further embodiment of any of the foregoing embodiments, the congruent angles are in a range from 5° to 40°.

A pump according to an example of the present disclosure includes an axial inducer that has a housing having an internal surface that defines an axial fluid passage. A rotor is disposed about a central axis in the fluid passage of the housing and has at least one blade defining at least one blade tip. The internal surface of the housing defines a plurality of grooves adjacent the at least one blade tip. Each of the grooves defines, with respect to a reference plane perpendicular to the central axis, a pitch angle that varies along the groove.

In a further embodiment of any of the foregoing embodiments, the pitch angle is forward pitch angle.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
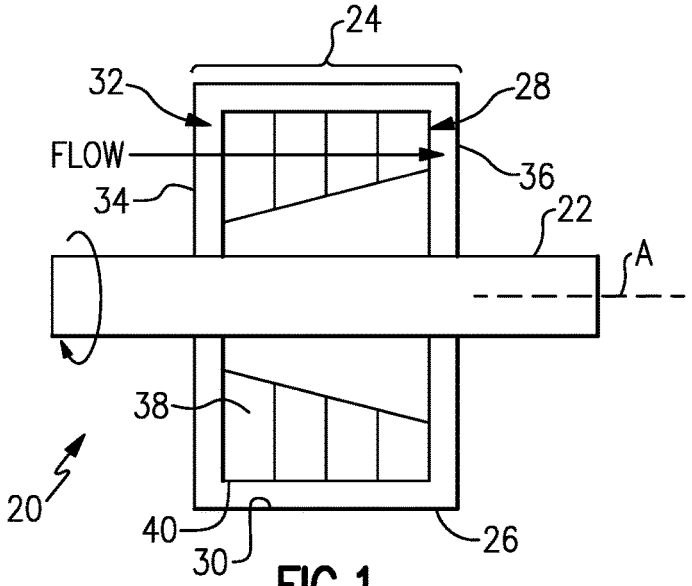
FIG. 1 illustrates an example pump having an inducer.

FIG. 1 schematically illustrates selected portions of a pump 20. As will be appreciated, the pump 20 may include other components that are not shown, such as but not limited to, one or more additional pump sections and/or a turbine. As will be described in further detail below, the pump 20 includes features that reduce flow induced instabilities that can cause catastrophic failure of the pump.

The pump 20 includes a shaft 22 that is generally rotatable about a central axis A. There is an inducer 24 disposed on the shaft 22. The inducer 24 includes a housing 26 that is static and a rotor 28 that is rotatable with the shaft 22. The housing 26 has an internal surface 30 that defines an axial fluid passage 32 for generally axial fluid flow between a pump inlet 34 and a pump outlet 36. The pump inlet and outlet 34/36 generally define "forward" and "aft" directions, and variations of those terms, wherein "forward" refers to directionality toward the inlet 34 and "aft" refers to directionality toward the outlet 36. Likewise, the central axis A generally defines directionality with regard to "axial," "radial, "circumferential," and variations of those terms.

Figure 2:
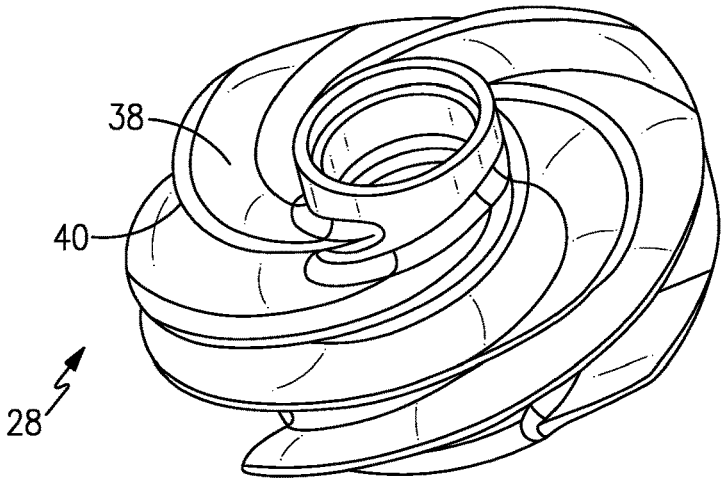
FIG. 2 illustrates an isolated view of a rotor of the pump of FIG. 1.

The rotor 28 is disposed about the central axis A in the fluid passage 32 of the housing 26. The rotor 28 includes one or more blades 38 that define at least one blade tip or edge 40. A magnified view of the rotor 28 is also shown in FIG. 2. In the example shown, the blades 38 are shroudless, although it is to be understood that the rotor 28 could alternatively be a shrouded rotor that includes one or more shrouds attached to the blade tips 40 and that rotate with the rotor 28.

Figure 3:
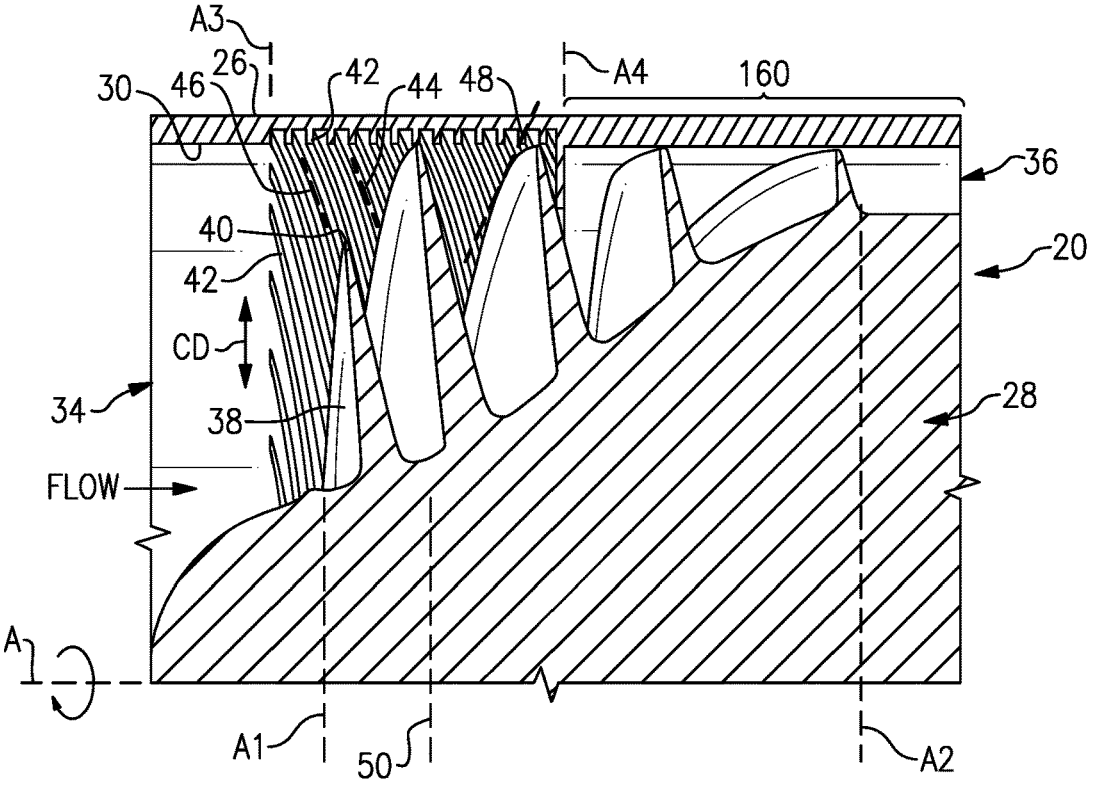
FIG. 3 illustrates a sectioned view of the pump of FIG. 1.

As shown in FIG. 3, the internal surface 30 of the housing 26 defines one or more grooves 42 that are adjacent one or more of the blades tips 40. For instance, the grooves 42 are radially aligned with one or more of the blade tips 40 and are uniformly axially spaced. In other words, the axial extent of the grooves 42 at least overlaps with the axial extent of the blades 38. The grooves 42 are elongated in a circumferential direction (CD). For instance, each such groove 42 defines a central groove axis 44 along which the groove 42 extends around the internal surface 30 and that is longer in the circumferential direction CD (or circumferential direction component) than in the axial direction (or axial direction component).

Figure 4:
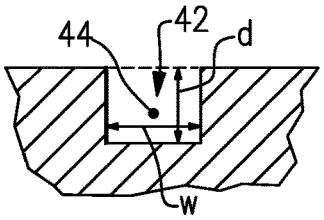
FIG. 4 illustrates a sectioned view of a housing of the pump.

In cross-section, as shown in a representative example in FIG. 4, the grooves 42 are rectangular, especially square, and are each of uniform cross-section along substantially their entire length. Moreover, the grooves 42 will most typically have the same or equal cross-section such that the grooves 42 are of equal geometry in cross-sectional shape and of equal dimension in width and depth. Alternatively, although rectangular equivalent grooves serve well for reducing flow induced instabilities, it is also contemplated that one or more of the grooves 42 may have a different cross-sectional shape than rectangular, such as semi-circular, ovular, or polygonal, and/or a different size in width or depth or other characteristic dimension.

Figure 5:
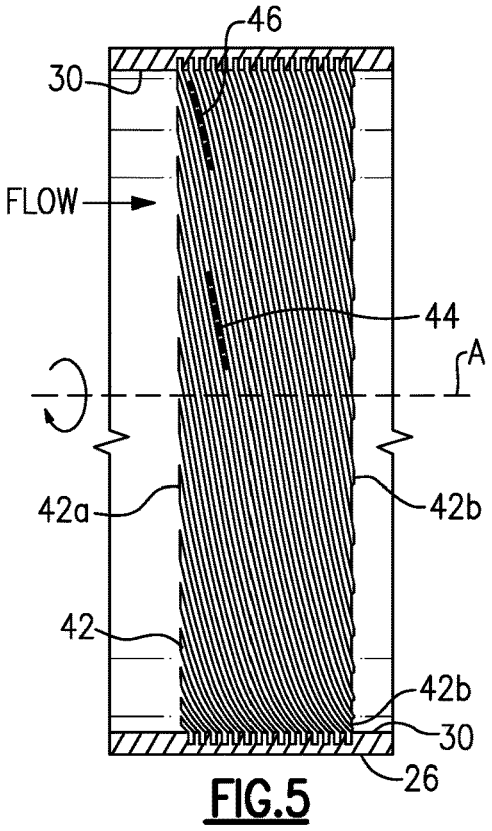
FIG. 5 illustrates a sectioned view through a groove of the housing of the pump.

Referring also to FIG. 5, which shows a sectioned view of a half of the housing 26, without the rotor 28, the grooves 42 in this example are ended grooves that each begin at a respective definitive first end 42*a* and terminate at a respective definitive second end 42*b*. The second end 42*b* is axially displaced aft of the first end 42*a* such that each groove 42 is a portion of a spiral. For instance, each groove 42 extends a distance around the internal surface 30 of the housing 26. Most typically, each groove 42 will extend less than 360° around the internal surface 30. In a further example, each groove 42 extends an equal or common distance around the internal surface 30. That is, the lengths of the grooves 42 along their central groove axes 44 from their distinct first end 42*a* to their distinct second end 42*b* are equal and wrap around in the internal surface 30 an equal amount. For instance, each groove 42 may wrap 90° around the internal surface, 180°, 270°, or other designated degree from 90° up to 360°.

During operation of the pump 20, as the rotor 28 and blades 38 rotate, there can be a backflow of fluid through the volume between the tips 40 of the blades 38 and the internal surface 30 of the housing 26, vortices at or near the blade tips 40, and/or cavitation at or near the blade tips 40 (the extent of which may relate to the type of fluid, pressures, temperatures, rotor speed, etc.). Collectively, such phenomenon are referred to herein as flow induced instabilities.

In this regard, the grooves 42 facilitate a reduction in flow instabilities. For instance, as the fluid flows near the blade tips 40, the rotation of the blades 38 moves the fluid into the grooves 42. Once in the grooves 42, the sides of the groove 42 stop the fluid from flowing any further forward in the pump 20, thereby reducing backflow.

Referring again to FIGS. 3 and 5, the grooves 42 and the blades 38 can be configured to enhance the reduction in flow induced instabilities. For instance, each of the grooves 42 defines a groove pitch 46 and the blade or blades 38 define a blade pitch 48. The groove pitch 46 is the angle of the line tangent to a point on the central groove axis 40 relative to a reference plane 50 that is perpendicular to the central axis A, i.e., the angle between the tangent line and the plane 50. Alternatively, an equivalent point of reference for the tangency can be on the bottom or sidewall of the groove 42. The blade pitch is the angle of the line tangent to a point on the blade tip 40 relative to the reference plane 50, i.e., the angle between the line and the plane 50. As will be appreciated, the selection the reference plane 50 for determining angles of the lines is a matter of convenience and the angles of the lines can be equally represented using other reference planes as long as the same reference plane is used for both lines.

The groove pitch 46 has a forward pitch angle and the blade pitch 48 has an aft pitch angle. Stated another way, the blade tips 40 are generally sloped in the aft direction from the central axis A, while the elongated directions of the grooves 42 are generally slanted in the forward direction from the central axis A. In one example, the forward pitch angle of the groove pitch 46 and the aft pitch angle of the blade pitch 48 are congruent angles. For instance, the groove tangent line forms a groove pitch angle of 10° with the reference plane 50 and the blade tangent line forms a blade pitch angle of 10° with the reference plane 50. Alternatively, if a nomenclature scheme is employed in which forward and aft are designated with opposite signs such as "+" (plus symbol) and "−" (minus symbol), the groove pitch angle may be represented as −10° and the blade pitch angle may be represented as +10°, or vice versa. As used herein, an angle that is negative and an angle that is positive due to a chosen nomenclature are considered to be congruent as long as the absolute values are equal.

The congruent angles may be varied in accordance with the type of fluid being pumped, expected operating temperature, expected operating pressure, and speed of the blade tips 40, for example. Most typically, the congruent angles are in a range from 5° to 40° (assuming a nomenclature in which forward and aft are both positive), or alternatively, one of the angles is in a range from +5° to +40° and the other angle is equal but opposite sign in a range from −5° to −40° (assuming a nomenclature in which forward and aft are opposite signs).

In further examples, the groove pitch angles can vary along the lengths of the grooves 42. For instance, the grooves 42 initially may have shallow groove pitch angles from the distinct first ends 42*a*, i.e., low angles relative to the plane 50. The groove pitch angle may then increase along the length of the grooves toward the distinct second ends, i.e., higher angles relative to the plane 50. Finally, the groove pitch angles may then decrease up to the distinct second ends 42*b*. That is, each groove 42 may have an initial low-angle extent, an intermediate higher-angle extent, and a trailing lower-angle extent. This permits the groove pitch angle to remain congruent with the blade pitch angle as the blade pitch angle varies axially along the blade tips 40 (edges). In one further example, the groove pitch angle may continuously vary along the length of the grooves.

During operation of the pump 20, the forward pitch angle of the grooves 42 coupled with the aft pitch angle of the blades 38 enhances reduction in flow induced instabilities in comparison to a no groove configuration. For instance, as the fluid near the internal surface 30 attempts to backflow toward the pump inlet 34, the rotation of the blades 38 moves the fluid into the grooves 42. Since the grooves 42 are pitched forward via the forward pitch angle and the blades 38 are pitched aft via the aft pitch angle, the blades tips 40 (edges) bridge the grooves 42. The rotational movement of the blades 38 across the grooves 42 serves to sweep the fluid to flow downstream in the groove 42 toward the pump outlet 36. To flow upstream, the fluid would need to overcome the sweeping action and pressure at the blade tips 40. The forward pitch angle and the aft pitch angle thereby generate a flow dynamic in which flow downstream in the grooves 42 is favored, thereby enhancing backflow reduction.

Figure 6:
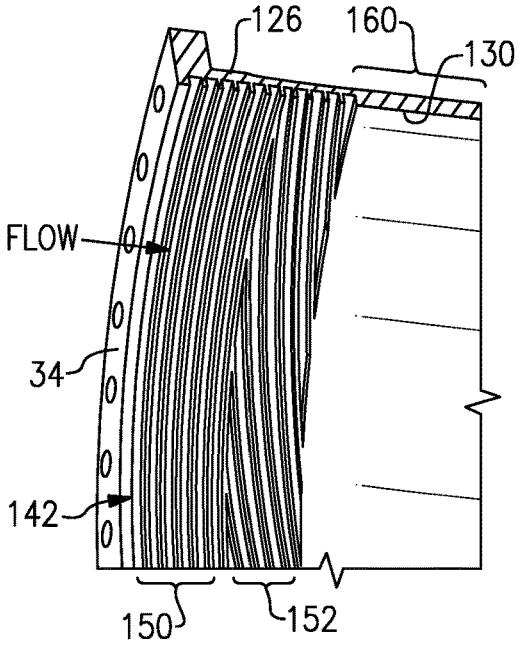
FIG. 6 illustrates another example of a housing of a pump.

FIG. 6 illustrates another example of a housing 126 that may alternatively be used in the pump 20. In this example, the housing 126 also includes an internal surface 130 and grooves 142 that are generally elongated in the circumferential direction. In this example, the grooves 142 include two different types of grooves, namely, endless grooves 150 and ended grooves 152. The ended grooves 152 may be similar to or the same as the grooves 42 described above. The endless grooves 150, however, do not have the distinct first and second ends 42*a*/42*b* as do the grooves 42. Rather, each groove 150 is a continuous annulus around the central axis A. Like the grooves 42, the grooves 150 are uniformly axially-spaced apart and the grooves 152 are uniformly axially-spaced apart.

In the illustrated example, there is a group of consecutive endless grooves 150, followed by a group of consecutive ended grooves 152 downstream or aft of the endless grooves 150. At the upstream location of the endless grooves 150, there is generally a lower pressure and thus a lesser need to resist backflow, while at the downstream position of the ended grooves 152, there is a greater pressure and need to resist backflow and thus grooves that have a forward pitch angle are used.

As also shown in each of FIGS. 3 and 6, either of the housings 26/126 may include a portion or band 160 that is aft of the grooves 42/142 and which excludes any grooves. That is, the internal surface 30/130 within the band 160 is smooth. As shown, for example, in FIG. 3, the axial extent of the grooves 42 (or alternatively the grooves 142) is non-coextensive with the axial extent of the blades 38. For example, the blades 38 begin at a first axial location, represented at A1, and the blades 38 terminate at a second axial position, represented at A2. The grooves 42 begin at a third axial location, represented at A3, and terminate at a fourth axial location, represented at A4. As shown, the fourth axial location A4 may be forward or aft of the second axial location A2.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A pump comprising:

an axial inducer including a housing having an internal surface defining an axial fluid passage, and a rotor disposed about a central axis in the fluid passage of the housing and having at least one blade defining at least one blade tip, the internal surface of the housing defining a plurality of grooves adjacent the at least one blade tip, the plurality of grooves being elongated in a circumferential direction, the plurality of grooves including an endless groove and an ended groove aft of the endless groove.

2. The pump as recited in claim 1, wherein the endless groove is one of a plurality of endless grooves and the ended groove is one of a plurality of ended grooves that are aft of the plurality of endless grooves.

3. The pump as recited in claim 2, wherein the plurality of endless grooves are uniformly axially-spaced apart.

4. The pump as recited in claim 1, wherein the plurality of grooves are of common aspect ratio with respect to groove depth and groove width.

5. The pump as recited in claim 1, wherein the plurality of grooves have a constant cross-section.

6. The pump as recited in claim 1, wherein the at least one blade begins at a first axial location, the at least one blade terminates at a second axial position, the plurality of grooves begin at a third axial location, the plurality of grooves terminate at a fourth axial position, and the fourth axial location is forward of the second axial location.

7. The pump as recited in claim 1, wherein the internal surface of the housing includes a band aft of the plurality of grooves that excludes any of the plurality of grooves.

8. The pump as recited in claim 1, wherein the plurality of grooves define, with respect to a reference plane perpendicular to the central axis, a forward pitch angle, and the at least one blade defines, with respect to the reference plane, an aft pitch angle.

9. A pump comprising:

an axial inducer including a housing having an internal surface defining an axial fluid passage, and a rotor disposed about a central axis in the fluid passage of the housing and having at least one blade defining at least one blade tip, the internal surface of the housing defining a plurality of grooves adjacent the at least one blade tip, the plurality of grooves defining, with respect to a reference plane perpendicular to the central axis, a forward pitch angle and the at least one blade defining, with respect to the reference plane, an aft pitch angle, the plurality of grooves including an endless groove and an ended groove aft of the endless groove.

10. The pump as recited in claim 9, wherein the forward pitch angle and the aft pitch angle are congruent angles.

11. The pump as recited in claim 10, wherein the congruent angles are in a range from 5° to 40°.

12. A pump comprising:

an axial inducer including a housing having an internal surface defining an axial fluid passage, and a rotor disposed about a central axis in the fluid passage of the housing and having at least one blade defining at least one blade tip, the internal surface of the housing defining a plurality of grooves adjacent the at least one blade tip, each of the grooves defining, with respect to a reference plane perpendicular to the central axis, a pitch angle that varies along the groove, the plurality of grooves including an endless groove and an ended groove aft of the endless groove.

13. The pump as recited in claim 12, wherein the pitch angle is a forward pitch angle.

* * * * *